US005903105A

United States Patent [19]

Lee et al.

[11] Patent Number: 5,903,105

[45] Date of Patent: May 11, 1999

[54] APPARATUS AND METHOD FOR CONTROLLING LIGHTING OF FLUORESCENT LAMP FOR REFRIGERATOR

[75] Inventors: Jang Hee Lee, Anyang; Jin Oh Seok, Suwon, both of Rep. of Korea

[73] Assignee: Samsung Electronics Co., Ltd., Suwon, Rep. of Korea

[21] Appl. No.: 08/897,825

[22] Filed: Jul. 21, 1997

[51] Int. Cl.[6] ..... F21V 33/00

[52] U.S. Cl. ..... 315/84; 315/307; 315/102; 315/105; 315/149; 315/106; 362/92; 362/94

[58] Field of Search ..... 315/DIG. 5, 307, 315/308, 149, 150, 159, 106, 107, 84, 102, 103, 105; 250/214 AL; 362/92, 94

[56] References Cited

U.S. PATENT DOCUMENTS 5,627,434 5/1997 Sekiya et al. ..... 315/94

*Primary Examiner*—Arnold Kinkead

*Attorney, Agent, or Firm*—Burns, Doane, Swecker & Mathis, L.L.P.

[57] ABSTRACT

A fluorescent lamp lighting control apparatus and method for use in a refrigerator is provided. Here, power is supplied according to opening of a refrigerator door and a fluorescent lamp is preheated for a predetermined time and is turned on by a counter-electromotive force supplied from a stabilizer after being preheated. The fluorescent lamp lighting control apparatus detects whether or not said fluorescent lamp is lit up, and repeats the lighting operation until said fluorescent lamp is lit up when it is detected that said fluorescent lamp is not lit up. Accordingly, the lighting operation of a fluorescent lamp installed in a refrigerator is secured.

5 Claims, 2 Drawing Sheets

APPARATUS AND METHOD FOR CONTROLLING LIGHTING OF FLUORESCENT LAMP FOR REFRIGERATOR

BACKGROUND OF THE INVENTION

The present invention relates to an apparatus for controlling the lighting of a fluorescent lamp for use in a refrigerator and a method therefor, and more particularly, to a fluorescent lamp lighting control apparatus and method for repeating the lighting operation until the fluorescent lamp is illuminated to secure the lighting.

Lamps which are lit according to opening of a refrigerator door are typically installed in a refrigerator. The lamps used in the refrigerator are chiefly incandescent lamps. The reason why an incandescent lamp is used in the refrigerator is due to a faster lighting time than that of a fluorescent lamp. A pre-heating time of approximately one second is generally necessary for lighting a fluorescent lamp. Since a flickering phenomenon occurs in the fluorescent lamp until it is illuminated, fluorescent lamps are used in places where frequent light-up operations are not performed. Hence, it is generally known that it is not preferable to employ a fluorescent lamp in a refrigerator which is frequently opened and closed.

There has been a recent trend toward the use a large-sized refrigerators in which fluorescent lamps are used. Fluorescent lamps have a higher power consumption efficiency in the order of one-third through a quarter times that of incandescent lamps. Also, the fluorescent lamps have the advantage of providing a comfortable light, a small amount of radiation heat and a lifetime of five to ten times that of one incandescent lamp. Therefore, it is appropriate to employ a fluorescent lamp in a large-sized refrigerator.

First, a light-up procedure of a typical fluorescent lamp will be described with reference to FIG. 2 which shows a schematic circuit diagram of a prior art fluorescent lamp light-up circuit. There are a variety of components necessary for lighting a fluorescent lamp 40. Here, a light-up circuit using a starter 35 will be described. Filaments 37 and 38 exists in both inner ends of the fluorescent lamp 40. These filaments 37 and 38 are connected to respective ends of the starter 35. Also, the two filament 37 and 38 are connected to a circuit composed of a stabilizer and an alternating-current (AC) power source 31 both of which are connected in series. As a result, a closed circuit (hereinafter called a preheating closed circuit) is formed by a cycle of the AC power source 31, the stabilizer 33, the left-hand filament 37, the starter 35, and the right-hand filament 38.

A microcomputer 50 detects opening of a refrigerator door and drives a relay 44 to turn on a switch SW, thereby starting the AC power supply 31. When a supply of power from the AC power source 31 starts, power is supplied along the preheating closed circuit to preheat the filaments 37 and 38. Upon the completion of the pre-heating step, a bimetal (not shown) in the starter 35 is cut off and a current flow toward the starter 35 is instantly stopped, to thereby generate a high-voltage counter-electromotive force in the stabilizer 33, cause discharge between the two filaments 37 and 38 in the fluorescent lamp 40 and light up the fluorescent lamp 40. After lighting up the fluorescent lamp 40, another closed circuit (hereinafter called a light-up closed circuit) is formed by a cycle of the AC power source 31, the stabilizer 33, the left-hand filament 37, and the right-hand filament 38, to maintain the lit state of the fluorescent lamp 40. Thereafter, when the refrigerator door is closed, the microcomputer 50 detects the closure of the door, drives the relay 44 to turn off the switch SW and to cut off the power supply from the AC power source 31. Thereby, the fluorescent lamp 40 is put out.

As described above, to light up a fluorescent lamp, a preheating operation and a counter-electromotive force supply from a stabilizer are required. Since the internal chamber in the refrigerator differs from a room in temperature and humidity, optimal preheating time necessary for lighting the fluorescent lamp in the internal chamber and a room is different from each other, to thereby cause an inferior light-up. The fluorescent lamp should be lighted after a time elapse necessary for preheating it, and it is not desirable to excessively preheat the fluorescent lamp to secure the light-up operation because such an excessive preheating may shorten the lifetime of the fluorescent lamp. If a lighting operation is set to a predetermined optimal preheating time, an inferior lighting will probably occur due to change of circumstance of the interior of the refrigerator. By the way, the conventional fluorescent lamp lighting control method maintains the fluorescent lamp in a turned-off state when an inferior lighting occurs. In this case, since the refrigerator door plays a role of a switch which connects and disconnects the power to and from the fluorescent lamp, users must close and open again in order to light up the fluorescent lamp to thereby feel inconvenient.

SUMMARY OF THE INVENTION

To solve the above problems, it is an object of the present invention to provide an apparatus for controlling a lighting operation of a fluorescent lamp to secure light-up of the fluorescent lamp by detecting an inferior lighting operation of the fluorescent lamp installed in a refrigerator and repeating the lighting operation until the fluorescent lamp is lit up.

It is another object of the present invention to provide a fluorescent lamp lighting control method for securing a lighting operation by repeating the lighting operation until a fluorescent lamp is lit up.

To accomplish the above object of the present invention, there is provided a fluorescent lamp lighting control apparatus for use in a refrigerator in which power is supplied according to opening of a refrigerator door and a fluorescent lamp is preheated for a predetermined time and is turned on by a counter-electromotive force supplied from a stabilizer connected in series to the fluorescent lamp after being preheated, the fluorescent lamp lighting control apparatus comprising: a light-up detector for detecting whether or not the fluorescent lamp is lit up; and a light-up controller for repeating of the lighting operation until the fluorescent lamp is lit up when it is detected that the fluorescent lamp is not lit up in the result of detection of the light-up detector.

The light-up detector comprises a transformer coil for transforming a voltage applied across a coil of the stabilizer; a rectifier for rectifying a waveform of the voltage output from the transformer coil; and a voltage level discriminator for discriminating whether the fluorescent lamp is lit up based on the size of voltage output from the rectifier, whereby the size of a counter-electromotive force output from the stabilizer can be detected to easily discriminate whether the fluorescent lamp is lit up.

The light-up detector further comprises a light emitting diode (LED) for emitting light according to voltage output from the rectifier; and a photo-transistor for outputting a voltage of a predetermined size according to the lighting of the LED, whereby the size of a counter-electromotive force output from the stabilizer can be detected to easily discriminate whether the fluorescent lamp is lit up.

According to another aspect of the present invention, there is also provided a fluorescent lamp lighting control method for use in a refrigerator which is performed by the above lighting control apparatus.

DETAILED DESCRIPTION OF THE INVENTION

A preferred embodiment of the present invention will be described with reference to the accompanying drawings.

Figure 1:
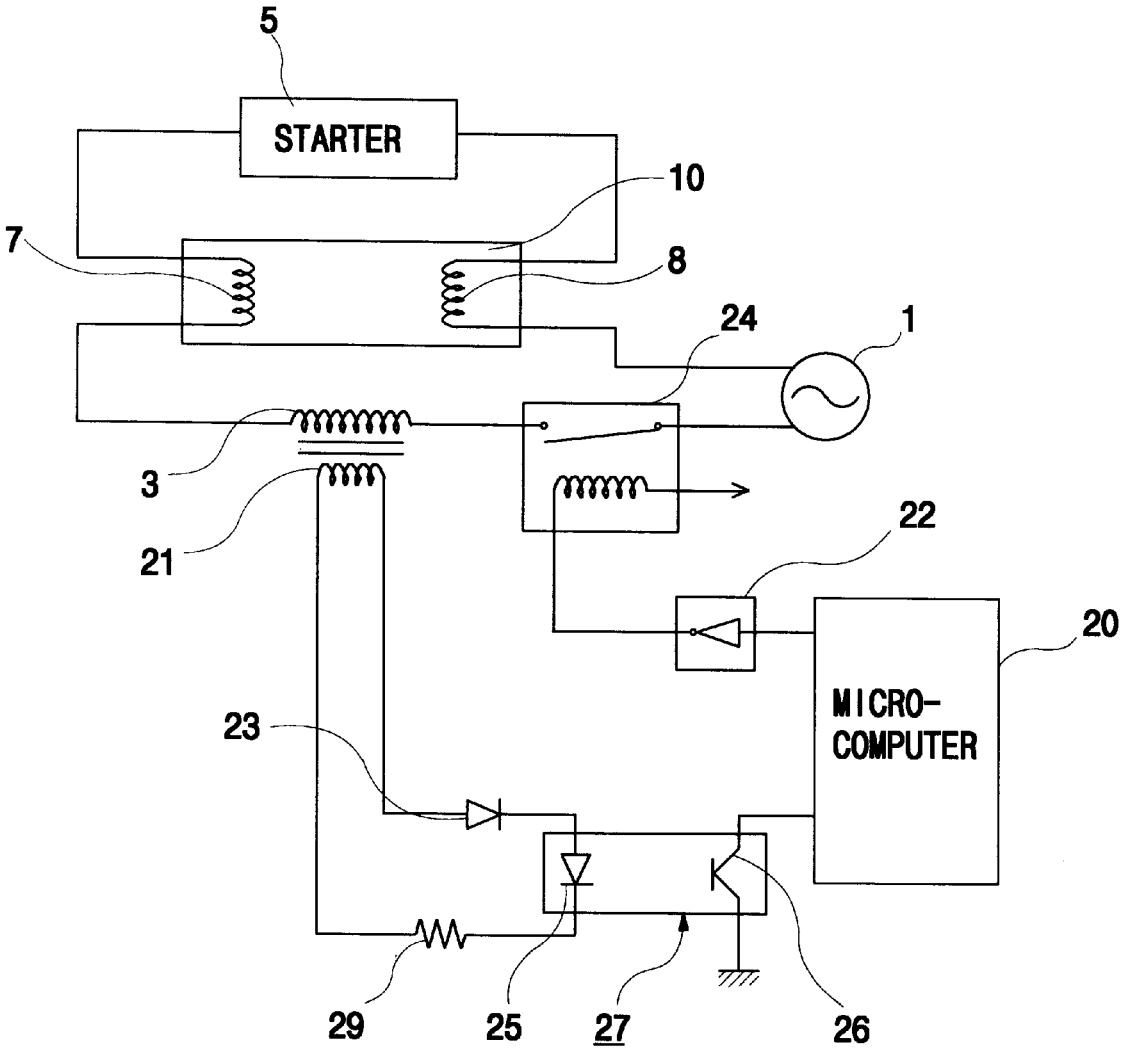
FIG. 1 is a schematic circuit diagram of a fluorescent lamp lighting control apparatus according to the present invention.
Figure 2:
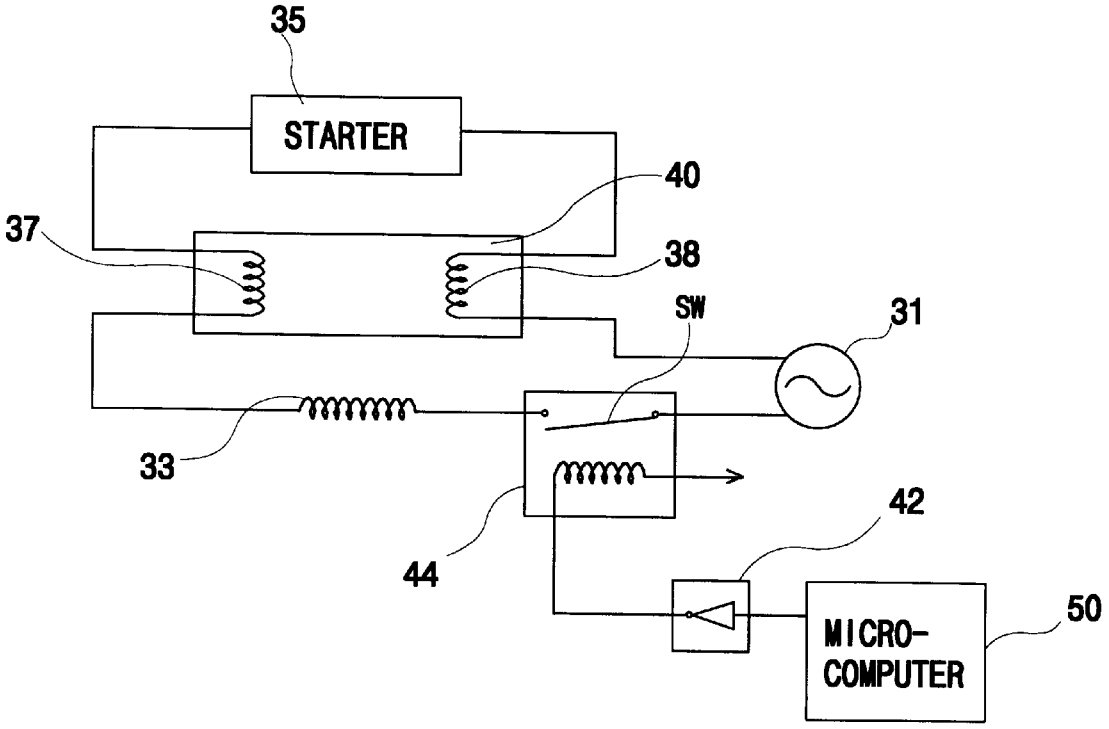
FIG. 2 (PRIOR ART)
FIG. 2 is a circuit diagram of a conventional fluorescent lamp lighting control apparatus.

Referring to FIG. 1, a fluorescent lamp lighting control apparatus according to the present invention includes a power source 1, a starter 5 and a stabilizer 3 as in the above-described conventional fluorescent lamp lighting control apparatus. Also, the operations of a microcomputer 20 for controlling the lighting of the fluorescent lamp 10 and a relay 20 driven under control of the microcomputer 10 are the same as those of the above-described conventional art.

A light-up detector is needed to discriminate whether a lighting operation is normally performed. The light-up detector includes a transformer coil 21, a diode connected in series to the transformer coil 21, and a photo-coupler 27 having a LED 25 and a photo-transistor 26. The transformer coil 21 reduces the voltage applied across the coil in the stabilizer 3 to a predetermined size necessary for driving other components of the light-up detector. The voltage reduced in the transformer coil 21 is half-wave rectified in the diode 23 to be supplied to the LED 25. The LED 25 emits light according to the supplied voltage. The emitted light is detected by the photo-transistor 26. Accordingly, the photo-transistor 26 outputs a voltage to the microcomputer 20.

If a sufficient counter-electromotive force is generated from the stabilizer 3, the photo-transistor 26 outputs a voltage of a predetermined size to the microcomputer 20. If not, the former 26 outputs a voltage smaller than the voltage of the predetermined size to the latter 20. If the microcomputer 20 receives the voltage of the predetermined size from the photo-transistor 26, the microcomputer 20 judges that the fluorescent lamp 10 is lit up, while if the former 20 receives the voltage smaller than the voltage of the predetermined size from the latter 26, the microcomputer 20 judges that the fluorescent lamp 10 is not lit up. In the meantime, a resistor 29 can be disposed between the photo-coupler 27 and the transformer coil 21 in order that a predetermined size of current (about 10 mA to 20 mA) flows in the LED 25.

A lighting operation can be repeated by driving again the relay 24 under control of the microcomputer 20, whose entire control procedure is as follows.

The microcomputer 20 senses whether the refrigerator door is opened or closed. If the microcomputer 20 senses the refrigerator door is opened, it outputs a signal, and the relay 24 is driven by the signal amplified through a driver IC 22 and then the switch SW is turned on. If the power starts to be supplied from the AC power source 1, the power is supplied along the above-described preheating closed circuit constituted by the AC power source 1, the stabilizer 3, the lefthand filament 7, the starter 5 and the righthand filament 8 to preheat the filaments 7 and 8. After the completion of the preheating, the starter 5 cuts off a current flow, in which case the stabilizer 3 generates a high-voltage counter-electromotive force to light up the fluorescent lamp 10. After lighting up the fluorescent lamp 10, a lighting closed circuit constituted by the Ac powers source 1, the stabilizer 3, the lefthand filament 7 and the righthand filament 8 is formed to maintain the light-up state of the fluorescent lamp 10.

Since the photo-transistor 26 outputs a predetermined voltage to the microcomputer 20 according to the high-voltage counter-electromotive force generated from the stabilizer 3 when lighting the fluorescent lamp 10 up, the microcomputer 20 judges that the fluorescent lamp 10 has been lit up and maintains the turn-on state of the switch SW in the relay 24. Thereafter, when the refrigerator door is closed, the microcomputer 20 detects the closure of the door and turns off the switch SW in the relay 24 to cut off power supply toward the fluorescent lamp 10 from the AC power source 1 to turn the fluorescent lamp 10 off.

If the fluorescent lamp 10 is not lit up due to an insufficient counter-electromotive force, the photo-transistor 26 does not output a voltage of the predetermined size. Then, the microcomputer. 20 turns off the switch SW in the relay 24 and immediately turns it on. As a result, a preheating closed circuit is formed again to perform a preheating operation via the condition of the starter, and then a lighting closed circuit is formed again to perform a lighting operation.

Such an on-and-off control of the switch SW in the relay 24 is repeated until the sufficient counter-electromotive force is generated from the stabilizer 3.

As described above, the fluorescent lamp lighting control apparatus and method according to the present invention can secure a reliable lighting operation of a fluorescent lamp by detecting an inferior lighting operation and repeating the lighting operation of the fluorescent lamp, until the fluorescent lamp installed in the refrigerator is lit up.

What is claimed is:

1. A fluorescent lamp lighting control apparatus for use in a refrigerator in which power is supplied according to opening of a refrigerator door and a fluorescent lamp is preheated for a predetermined time and is turned on by a lighting operation wherein a counter-electromotive force is supplied from a stabilizer connected in series to the fluorescent lamp after being preheated, the fluorescent lamp lighting control apparatus comprising:

a light-up detector for detecting whether or not said fluorescent lamp is lit up; and a light-up controller for repeating the lighting operation until said fluorescent lamp is lit up when it is detected that said fluorescent lamp is not lit up in the result of detection of said light-up detector;

wherein said light-up detector comprises:

a transformer coil for transforming a voltage applied across a coil of said stabilizer;

a rectifier for rectifying a waveform of the voltage output from said transformer coil; and a voltage level discriminator for discriminating whether said fluorescent lamp is lit up based on the size of voltage from said rectifier.

2. The fluorescent lamp lighting control apparatus according to claim 1, wherein said light-up detector further comprises: a light emitting diode (LED) for emitting light according to voltage output from said rectifier; and a photo-transistor for outputting a voltage of a predetermined size according to the lighting of said LED.

3. The fluorescent lamp lighting control apparatus according to claim 1, wherein said light-up detector comprises: a microcomputer; and a switching portion for connecting and disconnecting the power to and from said fluorescent lamp under control of said microcomputer.

4. A fluorescent lamp lighting control method for use in a refrigerator comprising the steps of:

starting to supply power according to opening of a refrigerator door, preheating a fluorescent lamp for a predetermined time and starting a lighting operation of the fluorescent lamp by a counter-electromotive force supplied from a stabilizer after being preheated;

detecting whether or not said fluorescent lamp is lit up by performing the substeps of:

transforming the voltage across the coil in said stabilizer;

rectifying the transformed voltage waveform; and discriminating whether the fluorescent lamp is lit up according to the size of the voltage of the rectified waveform; and repeating the lighting operation until said fluorescent lamp is lit up when it is detected that said fluorescent lamp is not lit up in the result of said light-up detection.

5. A fluorescent lamp lighting control method according to claim 4, wherein said light-up detection step further comprises sub-steps of: emitting light by applying the voltage output from the rectifying sub-step to a light-emitting diode (LED); and discriminating whether the fluorescent lamp is lit up according to the emission of the LED.

* * * * *